US006172012B1

(12) United States Patent
Kumar et al.

(10) Patent No.: US 6,172,012 B1
(45) Date of Patent: Jan. 9, 2001

(54) TITANIUM COMPLEX GREASE COMPOSITION INCLUDING PERFORMANCE ADDITIVES AND PROCESS FOR PREPARATION THEREOF

(75) Inventors: Anoop Kumar; S. C. Nagar; Kanta Prasad Naithani; M. M. Rai; Akhilesh Kumar Bhatnagar, all of Faridabad (IN)

(73) Assignee: Indian Oil Corporation Limited, Mumbai (IN)

( * ) Notice: Under 35 U.S.C. 154(b), the term of this patent shall be extended for 0 days.

(21) Appl. No.: 09/188,283

(22) Filed: Nov. 9, 1998

(51) Int. Cl.[7] ..... C10M 141/00
(52) U.S. Cl. ..... 508/165; 508/345; 508/378; 508/535
(58) Field of Search ..... 508/165

(56) References Cited

U.S. PATENT DOCUMENTS

| | | | |
|---|---|---|---|
| 3,928,214 | 12/1975 | Naka et al. | 508/123 |
| 4,514,312 | 4/1985 | Root et al. | 508/162 |
| 5,387,351 | 2/1995 | Kumar et al. | 508/165 |
| 5,741,762 | 4/1998 | Kahlman | 508/108 |

OTHER PUBLICATIONS

Smalheer et al "Lubricant Additives", Section I–Chemistry of Additives p. 1–11, Jan. 1967.

Naithani et al, "Evaluation of EP/AW Properties of Molybdenum Compounds/Graphite in Greases", Greasetech India, p. 17–20, Oct. 1998.

*Primary Examiner*—Ellen M. McAvoy
(74) *Attorney, Agent, or Firm*—Venable; George H. Spencer; Ashley J. Wells

(57) ABSTRACT

A lubricating grease composition includes from 2 to 20% by weight of titanium alkoxide; from 2 to 20% by weight of carboxylic acid other than fatty acid; from 5.0 to 35.0% by weight of fatty acids; from 0.0 to 5.0% by weight of water; from 20 to 90% by weight of oil selected from the group consisting of mineral and synthetic oil; and from 0.01 to 50% of performance additives.

8 Claims, No Drawings

TITANIUM COMPLEX GREASE COMPOSITION INCLUDING PERFORMANCE ADDITIVES AND PROCESS FOR PREPARATION THEREOF

BACKGROUND OF THE INVENTION

1. Field of the Invention

The present invention relates to titanium complex grease compositions having performance additives and to a process and compositions thereof. The additives envisaged by the present invention include anti-oxidants, extreme pressure and antiwear additives, rust inhibitors, friction modifiers, structural modifiers, polymers, solid lubricants, biodegradable additives/ashless additives, multifunctional additives etc.

2. Description of the Related Art

In prior art, the concept of thickening oils by soaps for lubrication purpose is well known. The usage of metallic soaps or their complex soaps as thickeners still dominates in lubricating greases. These metallic or complex metallic soap base greases are generally derived from metals such as lithium, calcium, sodium, barium, aluminum etc. Lithium base greases are mainly used, and probably for their better performance, easily availability and cost factors etc. Metallic soaps based on other metals have also been reported in prior art (C. J. Boner, Ind. Eng. Chem, 29, 59, 1937). However such metallic soaps did not have advantageous application in lubricating greases.

Such commercially used greases are associated with one or other disadvantages and are not able to meet fully the various requirements of modern machinery. For instance, most widely used lithium base greases use LioH but the restricted availability of lithium constitutes a disadvantage. Further, lithium has questionable toxicity (NLGI Spokesman, Apr. 1994). These greases require addition of certain performance additives which are costly and many of them are environmentally unsafe. The manufacture of such greases required large quantities of vegetable fats, which otherwise could have been used for edible and other industrial applications.

U.S. Pat. No. 5,387,351 in the name of the present applicants describes a lubricating grease composition based on titanium complex soap thickeners. Specifically, the lubricating grease composition of the aforesaid U.S. patent comprises 2 to 20% by weight of titanium alkoxide, 2 to 20% by weight of carboxylic additives acids, 5.0 to 35.0% by weight of fatty acids, 0 to 5.0% by weight of water and 20 to 90% by weight of oil selected from mineral and synthetic oil.

A primary object of this invention is to propose Ti-complex grease compositions incorporating certain performance additives and to a process for the preparation thereof.

Another object of this invention is to propose a Ti-complex grease composition incorporating performance additives with improved wild properties.

Still another object of this invention is to propose novel lubricating grease compositions with improved extreme pressure, anti, wear, antioxidant, rust and corrosion inhibition and frictional properties.

SUMMARY OF THE INVENTION

According to the invention there is provided a lubricating grease composition comprising b 2to 20% by weight of titanium alkoxide, 2 to 20% by weight of carboxylic acid, 5.0 to 35.0% by weight of fatty acids, 0.0 to 5.0% by weight of water and 20 to 90% by weight an oil selected from mineral and synthetic oil and 0.01 to 50% of performance additives.

In accordance with a preferred embodiment of this invention the lubricating grease composition 2 to 20% by weight of titanium alkoxide, 5 to 25% by weight of fatty acid, 2 to 20% by weight of carboxylic acid, 0.0 to 5.0% by weight of water and 20 to 90% by weight of oil selected from mineral and synthetic oil, and said performance additives.

DESCRIPTION OF THE PREFERRED EMBODIMENTS

The performance additives are selected from the following additives and present singularly or in any combination.

TABLE 1

| S.NO. | CLASS OF ADITIVIES |
|---|---|
| 1. | Extreme pressure |
| 2. | Antiwear additives |
| 3. | Antioxidant |
| 4. | Anti rust/ corrosion inhibitors |
| 5. | Friction modifiers |
| 6. | Structure modifiers/tackifier |
| 7. | Solid lubricants |
| 8. | Multifunctional additives |
| 9. | Biodegradable additives |

Further according to this invention there is provided a process for the preparation of lubricating grease composition which comprises in the step of forming in a first stage a mix by adding together 2 to 20% fatty acid, 2 to 20% carboxylic acid and 20 to 90% by weight of mineral or synthetic oil stirring and heating such a mix to a temperature of 70 to 100° C., adding in a second stage 2 to 20% by weight of titanium alkoxide while maintaining said temperature, raising the temperature to 100° C. to 200° C. to form a thickened grease product, cooling said product, and in a third stage adding 0 to 5% by weight of water thereto, if required, and then subjecting the mixture to the step of shearing, adding performance additives at 160-60° C. while cooling followed by homogenising/milling to obtain said composition.

In accordance with this invention, a vessel equipped with a stirrer or rpm 0–150 in the first stage, is charged with 5 to 35% by weight of fatty acid, 2 to 20% by weight of carboxylic acid and 20 to 90% by weight of mineral or synthetic oil, based on the total weight of the final grease composition.

The mixture is stirred and heat is provided through a heating mantle to reach the temperature to 70–100° C. At the end of the first stage, 2 to 20% by weight of titanium alkoxide is added slowly based on the total weight of the final grease composition.

The mixture is continuously mixed and held at 70–100° C. for 1–2 hour, temperature being raised very slowly to 100–200° C., duration of maintaining at this temperature is 2–8 hours. During this period the product assumes grease structure and converts to a thickened mass. The product is then cooled with continuous stirring to 140-100° C. at the end of this second stage, if desired up to 5% by weight of water is added to the mixture, based on the total weight of the final grease composition. The mixture is further cooled to 80-60° C. sheared with the help of a colloid mill adding said additives while cooling and followed by homogenizing and milling.

It is, however, possible to combine the first and second stages to provide an alternate route.

Thus, according to this invention there is provided an alternate process for the preparation of a lubricating grease composition which comprises in preparing in the first stage a mix by adding together fatty acid, carboxylic acid, titanium alkoxide and mineral or synthetic oil in required proportions, heating such a mixture to a temperature of 160 to 200° C. adding said additives at a temperature of 140 to 160° C. while cooling and then subjecting the composition to the step of homogenization and milling.

In accordance with the alternate process of this invention, the charge is stirred with simultaneous heating through a heating mantle. The mixture is heated upto a temperature of 160–200° C. in 2–8 hours. The resultant product is cooled to 140-80° C. and water is added from 0.1 to 5.0%. This is further stirred for 5 minutes to 1 hour at this temperature and then further cooled to 80-50° C. and sheared in a colloid mill.

Titanium alkoxide used in present invention is preferably titanium alkoxide of C3 to C6 alcohol having titanium metal content of 17% by weight approximately and used in the amount 2–20% by weight of the final lubricating grease composition. The synthetic hydrocarbon lubricating oil used in the compositions of present invention is an oligomer of olefin such as polyalpha olefins, polybutenes, polyethers, mineral base stocks are the neutral oils.

The sources of fatty acids employed in the grease composition are alkyl carboxylic acids from vegetable and animal source which may have few double bonds in the structure. For instance, it includes stearic acid, hydroxystearic acid, oleic acid, mahuwa oil, etc. and present in an amount of 5 to 35% by weight of the final lubricating grease composition.

The carboxylic acids employed in this invention invention are, for example, mono-carboxylic acid ranging from acetic acid to BVC acid, C2 to C10 carbon chain dicarboxylic acids, hydroxydicarboxylic acids such as tartaric acids and citric acid, aromatic acids include mono and dicarboxylic acids both, as well as hydroxy mono carboxylic acid, for example, benzoic acid, salicyclic acid, phthalic acid, terephthalic acid, (Table I). Inclusion of inorganic acids like boric and phosphoric is also the illustration of present invention. This is present in an amount 2.0 to 20% by weight of the final lubricating grease.

The comprehensive range of additives employed in this invention is categorised in Table 2 hereinbelow. These type of additives include hindered phenols, aminic compounds, amino-phenol compounds, thiophosphates and carbamates of Zn, Mo, Sb, Bi, Ti, Pb etc., ashless thiophosphates, benzotraizoles, benzothiqzolines, benzothiazolinethione derivates, phosphites, various substituted amines, oligomers of quinolines, phpenothiazine, organo metallic complexes of copper, thiadiazole derivatives, alkyl/aryl derivatives of phosphates, soluble Mo type additives, petroleum/synthetic sulfonates of Ba, Na, Ca, Zn, Li etc., overbased metal sulfonates, borated compounds, sarocosines, imidazolines, mono/dimetallic salts of discarboxylic acids, diesters of sebacic acids, mercptobenzothiazoles, linear isobutyline polymers, methacrylate/functionalised methacrylate copolymer, methacrylate-styrene copolymer, ethylene-propylene copolymer, styrene diene copolymers, Mos2, graphite, resins, fumed silica etc.

The antioxidants are present in the amount of 0.01 to 5% by weight.

The extreme pressure, antiwear, rust inhibitor, friction modifier, and structure modifier are each present in the amount of 0.01 to 10% by weight.

The composition contains at least a single solid lubricant and present in the amount of 0.1 to 50% by weight.

TABLE 2

| | | |
|---|---|---|
| 1. | | Antioxidants: The antioxidants employed in the process of the present invention are selected from one or more of the following: |
| (i) | (a) | Phenolic antioxidants hindered phenols amino - 4 hydroxy benzyl phosphorodithioate |
| | (b) | Cyclic hindered phenyl borates |
| | (c) | Di-Bu-2, 6-di-tert-butyl phenyl borates |
| | (d) | Dibenzyl phenolic compounds |
| | (e) | 4( , -Dihydrocarbyl-alpha-cyanomethyl phenols) |
| | (f) | Bis-2, 6-tert-butyl phenol & their sulphur containing derivative |
| (ii) | | Aminic Antioxidants: |
| | (a) | Phenyl-alpha-naphtylamine and NN'-dimethyl tetralone-hydrozone |
| | (b) | N,N',N"-tri substituted bis (P-aminobenzyl) anilines |
| | (c) | (Aminoxy) alkylamines |
| | (d) | 4( -phenyl ethyl)-2-hydroxydiphenyl amine |
| | (e) | P,P' dioctyl diphenyl amine |
| | (f) | Mixed alkyl dephenyl amine |
| (iii) | | Aminophenol Antioxidants: |
| | (a) | N-substituted -4-hydroxypheylthiomethyl amine or urides |
| | (b) | Octylated diphenyl amines |
| (iv) | | Thiophosphate based Antioxidants: |
| | (a) | Zn dialkyl dithiophosphates |
| | (b) | Ashless thio-phosphates |
| | * | Reaction product of dithiophosphoric acid ester and aldehyde |
| | * | S-(hydroxylphenyl) thiophosphates |
| | * | Bis(dialkyl dithiophosphate) alkylene polyamine |
| | (c) | Combination of Mo Bis (p-tert-butylphenyl) bis (p-nonylphenyl) and dialkylphenyl dithiophosphates |
| (v) | | Other Antioxidants |
| | (a) | Combination of Mo complexes of Mannich base and didodecyl sulphides |
| | (b) | N-tert-octyl benzotriazole |
| | (c) | 1-(di(2-ethylhexyl) amino methyl) benzotriazole |
| | (d) | Benzothiazolines |
| | (e) | Benzothiazoline -thione derivatives |
| | (f) | (Benzo) triazole |
| | (g) | Alkyl resorcinol phosphite |
| | (h) | thiobis (alkyl phenol)/dithiobis (alkyl-phenol) |
| | (i) | 2(3,5-di tert-butyl-4-hydroxypheyl)-3-benzl-4-thiozolidinone |
| | (j) | Composition of para - butylated and octylated ortho-ethylated dipheylamines |
| | (k) | Butoxy carbonyl phenyl animo methyl thiobenzo thiazole |
| | (l) | Complex of copper with 2-hydroxy-3-naphthemic arylamides |
| | (m) | 3,7-di-tert-octyl phenothiazine |
| | (n) | Oligomers of trimethyldiphydroquinoline |

TABLE 3

| | | |
|---|---|---|
| 2. | | Extreme Pressure and Antiwear Additives: The extreme pressure and antiwear additives are selected from one or more of the following: |
| (i) | | Heterocyclic Compounds: |
| | (a) | thiirane derivatives with thiophosphate & thiocarbamates |
| | (b) | Dithiobis (thiadiazole thiol) |
| | (c) | Benzothiazoline thione |
| | (d) | Substituted dimercapto-thiadiazole |
| | (e) | Imidazolidine dimethylene bis phosphoro dithioate |

TABLE 3-continued

| | | |
|---|---|---|
| | (f) | Derivatives of pyridine, pyrazine, pyrimidine and pyridazine and their fused ring derivatives |
| (ii) | Phosphates: | |
| | (a) | Triaryl phosphates, triphenyl phosphates, tritolylphosphate, trixylyl phosphates and mixed aryl phosphates. |
| (iii) | Metal Complexes: | |
| | (a) | Zn and Mo dithiophosphate |
| | (b) | Souble Mo type additives |
| | (c) | Zn diisopropyl dithiophosphate tetra-methylenediamine |
| | (d) | Zn dipropylglycolate dithiophosphate |
| | (e) | Product of tallow, dietholamine and ammonium molybdate |
| | (f) | Mo oxysulfide dithiocarbamate |
| | (g) | Sulfurized oxy Mo organo phosphorothioate |
| | (h) | Lead diamyl dithiocarbamate |
| | (i) | Organo Pb—S additive |
| | (j) | Antimony dialkyl dithiocarbamate |
| | (k) | Sb dialkyl dithiocarbamate |
| | (l) | Ba petroleum sulfonate/synthetic barium dinonylnaphthalene sulfonate |
| (iv) | Other Types: | |
| | (a) | Triphenyl phosphorothionate |

TABLE 4

| | | |
|---|---|---|
| 3. | Friction Modifiers: The friction modifiers used in the present invention are selected from one or more of the following: | |
| (i) | Mo-Complexes: | |
| | (a) | Mo dithiophosphates and Mo-dithiocarbamates. |
| | (b) | Reaction product of sulfurised dodecyl phenol and alkylbenzene sulfonic acid. |
| | (c) | Overbased Mo-alkylene earth metal sulfonates. |
| (ii) | Boron Derivatives: | |
| | (a) | 2,6-di-tert-butyl-4-methyl phenyl-borate. |
| | (b) | Borated polyhydroxy-alkyl sulfides. |
| | (c) | Borated N-hydrocarbyl alkylene triamines. |
| | (d) | Product of boric acid and cocosyl sarcosene. |
| | (e) | Product of 1,2-hexadecanediol,C19–C15 alcohols and boric acid. |
| | (f) | Zinc salts of partially borated and partially phosphosulfurised penta or dipentaerythritol. |
| (iii) | Amines/Amides/Hetrocylic Compounds: | |
| | (a) | N-oleylglycolamide |
| | (b) | N-alkoxylakylene diamine diamide |
| | (c) | N-cocoformamide |
| | (d) | Dialkoxy alkyl polyoxylakyl amines |
| | (e) | Dialkoxylated alkylpolyoxy alkyl amine |
| | (f) | Product of 4,4-thiodiphenol, formaldehyde and cocoamines |
| | (g) | Reaction products with P205 and sub, oxazolines or sub imidazolines |
| | (h) | Reaction products of sub hydroxyl-methyl imidazoline and acyl sarocosine |
| | (i) | Salts of imidazolines. |

TABLE 5

| Rust and Corrosion Inhibitors | | |
|---|---|---|
| | | The rust and corrosion inhibitors used in the present invention are selected from one or more of the following: |
| | (a) | Benzotriazole type/chemical derivative of benzotriazole containing more than one benzotriazole nuclei. |
| | (b) | Nonyl-phenoxy-acetic acid. |

TABLE 5-continued

| Rust and Corrosion Inhibitors | | |
|---|---|---|
| | (c) | N-acyl derivatives of sarcosine (N-methyl glycine) |
| | (d) | High molecular weight substituted imidazoline |
| | (e) | Disodium salt of an aliphatic dicarboxylic acid |
| | (f) | Diesters of sebacic acid |
| | (g) | Zine-di-n-butyldithiocarbamate |
| | (h) | Sodium mercapto benzothioazole |
| | (i) | Z-mercapto benzothiazole |
| | (j) | Zn dianyldithiocarbamate |
| | (k) | Ba petroleum sulfonate |
| | (l) | Sodium dinonyl naphthalene sulfonate |
| | (m) | Zn dinonyl naphthalene sulfonate |
| | (n) | Li dinonyl naphthalene sulfonate |

TABLE 6

| | | |
|---|---|---|
| | | Multifunctional additives used in the present invention are: |
| | (a) | Alkyl derivative of 2,5-di-mercapato-1,3,4-thiadiazole |

TABLE 7

| Structure modifiers: | | |
|---|---|---|
| | | The structure modifiers used in the present invention are selected from one or more of the following: |
| | (i) | Linear isobutylene polymer. |
| | (ii) | Methacrylic polymer/functionalised methacrylate copolymer. |
| | (iii) | Methacrylate-styrene copolymer. |
| | (iv) | Ethylenepropylene vinyl alkyl ketone polymer. |
| | (v) | Ethylene-propylene copolymers grafted with glycidyl methacrylates. |
| | (vi) | Styrene-diene copolymers |
| | (vii) | Ester modified styrene-diene polymers. |

These performance additives have been added in the grease composition as single component or more in combination to get synergistic or antagonestic effects. The effect of these additives on lubricating grease properites has been systematically studied by suitable evaluation techniques as per ASTM/IP test methods as described in Table 8. The total quantity of these additives alone/or in combination ranges from 0.01 to 50% by weight.

TABLE 8

ASTM/IP STANDARDS USED IN THE EVALUATION OF NEW GENERATION HIGH PERFORMANCE TITANIUM COMPLEX GREASE

| | | |
|---|---|---|
| 1. | Cone penetration of lubricating greases | ASTM D-217 |
| 2. | Drop point of lubricating greases | ASTM D-566/D-2265 |
| 3. | Life performace of automotive wheel bearing grease. | ASTM D-3527 |
| 4. | Corrosion preventive properties of lubricating greases. | ASTM D-1743 |
| 5. | Determination of EP/AW properties of lubricants. | IP 239 |
| 6. | Wear preventive characteristics of lubricating greases. Four ball method. | ASTM D-2266 |
| 7. | Oxidation stability of lubricating by the oxygen bomb method. | ASTM D- 942 |
| 8. | Determination of corrosiveness to copper of lubricating grease strip method. | IP-112 |

In order to describe more fully the nature of the present invention, specific examples will be hereinafter be described. It should be understood, however, that this is done solely by way of example and is intended neither to delineate nor limit the ambit of the appended claims.

EXAMPLE NO. 1

The lubricating grease composition was prepared containing the ingredients with proportionss indicated as described hereinbelow and following the process as indicated above. Here fatty acid used is stearic acid 5.6% and titanium alkoxide is titanium tetraisopropoxide, 6.6%. Table 9 exemplifies the various carboxylic acids tried in the preparation of the lubrication grease of the present invention.

TABLE 9

Carboxylic acids used in the inventions

| S.NO. | Carboxlic acid | Structure |
|---|---|---|
| 1. | Acetic acid | $CH_3COOH$ |
| 2. | B.V.C. acid | $CH_3(CH_2)_nCOOH$ |
| 3. | Oxalic acid | $(COOH)_2$ |
| 4. | Malonic acid | $CH_2(COOH)_2$ |
| 5. | Succinic acid | $(CH_2)_2(COOH)_2$ |
| 6. | Glutaric acid | $(CH)_3(COOH)_2$ |
| 7. | Azelaic acid | $(CH_2)_7(COOH)_2$ |
| 8. | Sebacic acid | $(CH_2)_8(COOH)_2$ |
| 9. | Tartaric acid | (CH(OH)COOH) |
| 10. | Citric acid | $(C_1H_2COOH$ $C_1(OH)COOH$ $CH_2COOH$ |
| 11. | Benozoic acid | $C_6H_5COOH$ |
| 12. | Salicylic acid | $C_6H_4(CH)COOH$ |
| 13. | Phthalic acid (ortho benzene dicarboxylic acid) | $C_6H_4(COOH)_2$ |
| 14. | Terephtalic acid (para benzene dicarboxylic acid) | $C_6H_4(COOH)_2$ |
| 15. | Fumaric acid | $( CH COOH )_2$ |
| 16. | Maleic acid | $( CH COOH)_2$ |
| 17. | Cinnamicacid | $C_6H_5CH{=}CH{-}COOH$ |

EXAMPLE NO. 2

The lubricating grease composition was prepared as describedd in example 1 with a difference that antioxidants such as hindered phenols, amino phenols, cyclic hindered phenyl borates, aminic compounds ashless and metallic thiophosphates, benzothiazoles, Ti-DTC, Bi-DTC, phosphites, complexes of copper, quinolines, carbamates of Zn, Sb, Mo, Zinc dialkyldithiophosphate, dibenzyl paracresol, butylated (Mono/di) phenyl amines etc. were added in the concentration 0.01–10% at the temperature 140–160° C. while cooling. The mass was then homogenised/milled to get final structure. Thus obtained greases were tested for critical properties such as drop point, penetration, oxidation stability as per D-942 etc. It was illustrated in this invention that these additives substantially influence the properties specifically oxidation resistance of the formulated grease.

For instance, the lubricating grease composition has been prepared containing ingredients with properties as described hereinabove. The antioxidant ditert butyl paracresol (0.01–5.0%) was added in the composition at 80–120° C. before milling or homogenising. Following physico chemical properties were exhibited by formulated grease.

TABLE 10

| S.NO. | PROPERTY | METHOD | RESULTS |
|---|---|---|---|
| 1. | Penetration at 25 dec C. after 60 strokes | D-217 | 267 |
| 2. | Drop point deg C. | D 2265 | 292 |
| 3. | Copper corrosion at 100° C. after 24 hrs | IP-112 | Pass |
| 4. | Oxidation stability at 99° C. pressure drop after 100 hrs. psi | D-942 | 1.0 |

Addition of ditert parabutyl cresol reduced pressure drop after 100 hrs in ASIN D-942 from 1.5 to 1.0 thus improving antioxidant properties.

The effectiveness of lubricating grease composition described demonstrates its improved oxidation stability while retaining drop point, corrosion resistance etc.

EXAMPLE NO. 3

Lubricating greases compositions were prepared as described in Example 1. The performance additives in these composition are specifically extreme pressure and antiwear additives viz, sulfurised fat, carbamates, phosphates, sulphurised isobutylene, dibenzyl disulphide, thiadiazoles, derivatives of pyridine, pyrazine, pyrimidine and pyridazine and their fused ring derivatives etc. Carbamates are generally alkyl carbamates of Zn, Sb, Mo, Pb etc. and alkyl phosphates specially derived from Zn, Mo, Bi, Ti etc.

As a typical examples, zinc dialkyl dithiocarbamate is added in the Ti-complex grease in the process as indicated hereinabove. The dosage ranges from 0.01 to 10.0%. The resultant grease exhibited following physico chemical characteristics.

TABLE 11

| S.NO. | PROPERTY | METHOD | RESULTS |
|---|---|---|---|
| 1. | Penetration at 25 deg C. after 60 strokes | D-217 | 280 |
| 2. | Drop point deg C. | D 2265 | 290 |
| 3. | Copper corrosion | IP-112 | Pass |
| 4. | Weld load, kg | IP-239 | 400 |
| 5. | Wear scar dia, min. | D-2266 | 0.50 |

Zn dialkyldithiocarbamate in Ti-complex grease has increased weld load from 250 kg. to 400 kg. thus improving extreme pressure properties. This composition retained high drop point, good corrosion resistance while, giving improved extreme pressure and antiwear properties.

EXAMPLE NO. 4

This example illustrates the wide range of rust inhibitors generally used in conventional lubricants and greases have been used to make different grease compositions by method described hereinabove. The dosage added between temperature 140–60 deg C. varies from 0.01 to 10.0%.

The wide range of rust inhibitors envisaaged by the present invention are generally imidazolines, chemical derivatives of benzotriazole, sarcosines, metallic derivatives of dicarboxylic acids e.g. disodium sebacate, borates, mercapto benzothiazoles, sulfonate, amines and their derivatives. For instance, in one of the embodiment disodium sebacate was added in concentration of 1–10% during the processing of Ti-complex grease. Following physico-chemical characteristics were obtained with this composition.

TABLE 12

| S.NO. | PROPERTY | METHOD | RESULTS |
|---|---|---|---|
| 1. | Penetration at 25 deg C. after 60 strokes | D-217 | 280 |
| 2. | Drop point deg C. | D 2265 | 290 |
| 3. | Copper corrosion | IP-112 | Pass |
| 4. | Rust preventive properties | D-1743 | Pass |
| 5. | Emcor rating | | 0 |

Therefore, this composition has exhibited, good corrosion resistance, high drop points, improved rust preventive characteristics.

EXAMPLE 5

Various structure modifiers were added during manufacture of Ti-complex grease. The grease compositions prepared with different type of structure modifiers are polymers viz, ethylene propylene, copolymer, styrene-hydrogenated butadiene (SBR) copolymer, styrne-isoprene (SI) block copolymers, polyisobutylene (PIB) polymers, nonelasomeric polymethacrylate (PMA) polymers etc. resins waxes, clays, fumed silica etc. The chemicals/compounds were added in lubricating grease compositions at a temperature of between 25–200 deg C. or while cooling the total mass. The lubricating greases obtained were tested for physico chemical characteristics and it was found that these components significantly influence properties of Ti-complex grease.

In one of the preferred composition, the lubricating grease compositing was prepared with 1–10% of ethylene propylene type copolymer. The corresponding Ti-complex grease exhibited following physico-chemical characteristics.

TABLE 13

| S.NO. | PROPERTY | METHOD | RESULTS |
|---|---|---|---|
| 1. | Penetration at 25 deg C. after 60 strokes | D-217 | 270 |
| 2. | Drop point, deg C. | D 2265 | 290 |
| 3. | Lub. life, hrs | D 3527 | 160 |

The composition has improved long high temperature life, while retaining other properties.

EXAMPLE 6

This example relates to the usage of more than one type of additives in lubricating Ti-complex grease. The single composition consists of general type additives such as Anti-oxidants, Extreme pressure, AW additives, Rust inhibitors, structure modifiers and rust inhibitors and similar various other combinations.

This invention is more clear by the following specific example. The lubricating grease composition was prepared by addition of 0.1–10% zinc dialkyl dithiocarbamate and 0.1–10% sulfurized fat in the normal Ti-complex grease processing method. This composition exhibited certain excellent physico-chemical characteristics.

TABLE 14

| S.NO. | PROPERTY | METHOD | RESULTS |
|---|---|---|---|
| 1. | Worked penetration | D-217 | 275 |
| 2. | Drop point, deg C. | D 2265 | 296 |
| 3. | Copper corrosion | IP-112 | Pass |
| 4. | Weld load, Kg. | IP-239 | 620 |
| 5. | Wear Scar dia, mm | D-2266 | 0.6 |

This combination of additives increased weld load from 350 kg to 620 kg. This composition possesses excellent high drop point, good corrosion resistance, remarkably enhanced extreme pressure properties. Similarly other sets of combinations also showed good encouraging results.

EXAMPLE NO. 7

Here lubricating grease compositions has been prepared consisting ingredients with proportion hereinabove. The example has a variation of addition of solid lubricants such as MoS2, graphite etc. As an specific example, 1–50% MoS2 was added to the grease composition and the following physico-chemical characteristics were obtained as shown in Table-15.

TABLE 15

| S.NO. | PROPERTY | METHOD | RESULTS |
|---|---|---|---|
| 1. | Worked Penetration at 25 deg C. | D-217 | 285 |
| 2. | Drop point, deg C. | D 2265 | 295 |
| 3. | Copper corrosion | IP-112 | Pass |
| 4. | Oxidation stability, Psi drop after 100 hrs. | D-942 | 1.0 |
| 5. | Weld load, kg | IP-239 | 620 |
| 6. | Wear scar dia, mm | D-2266 | 0.5 |

Addition of MoS2 enhanced weld load from 350 kg. to 620 kg. This composition has specifically improved extreme pressure and antiwear properties.

EXAMPLE NO. 8

This example relates to the addition of more than one solid lubricant in single grease formulation. These additives were added in the range 1–30% by weight of total concentration.

An specific example, of the addition of 60% graphite and 40% MoS2 was effected at between 160–80 deg C. while cooling. The following physico chemical characteristics were obtained as shown in Table 16.

TABLE 16

| S.NO. | PROPERTY | METHOD | RESULTS |
|---|---|---|---|
| 1. | Worked Penetration, 25 deg C. | D-217 | 270 |
| 2. | Drop point, deg C. | D 2265 | 290 |
| 3. | Weld load, kg | IP-239 | 700 |
| 4. | Wear scar dia, mm | D-2266 | 0.55 |

This composition has specifically shown, high weld load and excellent antiwear properties. This composition has also shown synergisim of MoS2:Graphite combination as in case of other lubricating greases.

Reference is now made in particular to the improved weld load properties obtained by the addition of said additives to the titanium grease composition. Table 17 hereinbelow shows the improvement of the weld load with respect to other greases.

TABLE 17

| Grease Composition | Weld load, kg. |
|---|---|
| Lithium Base Grease | 140 |
| Lithium Base Grease + x% Zinc Dialkyl Dithiaphosphate | 200 |
| Lithium Base Grease + x% Zinc Dialkyl Dithiaphosphate + y% Sulfurised Fat | 225 |
| Titanium Complex Grease | 315 |
| Titanium Complex Grease + x% Zinc Dialkyl Dithiaphosphate | 355 |
| Titanium Complex Grease + x% Zinc Dialkyl Dithaphosphate + y% Sulfurised Fat | 620 |

The results indicate that the addition of EP additives has increased weld load significantly in Ti-complex grease.

What is claimed is:

1. A lubricating grease composition, comprising:

from 2 to 20% by weight of titanium alkoxide;

from 2 to 20% by weight of carboxylic acid other than a fatty acid;

from 5.0 to 35.0% by weight of fatty acids;

from 0.0 to 5.0% by weight of water;

from 20 to 90% by weight of oil selected from the group consisting of mineral and synthetic oil; and from 0.01 to 50% by weight of at least one performance additive comprised of an extreme pressure additive which comprises zinc dialkyl dithiaphosphate in combination with a solid lubricant which comprises sulfurized fat.

2. The lubricating grease composition as claimed in claim 1, wherein said extreme pressure additive and said solid lubricant are each present in an amount ranging from 0.01 to 10% by weight.

3. A process for preparation of a lubricating grease composition, comprising the steps of:

forming a mixture in a first stage by adding together fatty acid, carboxylic acid other than a fatty acid and one of mineral or synthetic oil;

stirring and heating the mixture to a temperature ranging from 70 to 100° C.;

adding titanium alkoxide to the mixture in a second stage while maintaining said temperature;

forming a thickened grease product by raising the temperature to from 100 to 200° C.;

cooling said thickened grease product;

optionally adding water to the thickened grease product in a third stage;

subjecting the thickened grease mixture to shearing;

adding at least one performance additive comprised of an extreme pressure additive which comprises zinc dialkyl dithiaphosphate in combination with a solid lubricant which comprises sulfurized fat at a temperature ranging from 60 to 160° C. while cooling; and subjecting the thickened grease mixture after cooling to at least one of homogenizing or milling.

4. The process as claimed in claim 3, wherein from 2 to 20% of titanium alkoxide is added.

5. The process as claimed in claim 3, wherein the mixture in the first state is continuously mixed and is held at a temperature ranging from 70 to 100° C. for from 1 to 2 hours and, in the second stage, is held at a temperature ranging from 100 to 200° C. for a period of 2 to 8 hours.

6. The process as claimed in claim 3, wherein the mixture is cooled with continuous stirring to a temperature ranging from 100 to 140° C. and from 0 to 5% by weight of water is added.

7. A process for the preparation of a lubricating grease composition, comprising:

preparing a mixture in a first stage by adding together fatty acid, carboxylic acid other than a fatty acid, titanium alkoxide and an oil selected from the group consisting of mineral and synthetic oil;

heating said mixture to a temperature ranging from 160 to 200° C.;

cooling said mixture to a temperature ranging from 100 to 140° C.;

optionally adding water to the mixture after cooling in a second stage;

stirring said mixture after cooling;

further cooling said mixture;

adding at least one performance additive comprised of an extreme pressure additive which comprises zinc dialkyl dithiaphosphate in combination with a solid lubricant which comprises sulfurized fat to the mixture after further cooling; and subjecting the mixture to shearing.

8. The process as claimed in claim 1, wherein said mixture is cooled in from 2 to 8 hours.

* * * * *